US008685266B2

(12) United States Patent
Parker et al.

(10) Patent No.: US 8,685,266 B2
(45) Date of Patent: Apr. 1, 2014

(54) MONOCYCLIC HIGH ASPECT RATIO TITANIUM INDUCTIVELY COUPLED PLASMA DEEP ETCHING PROCESSES AND PRODUCTS SO PRODUCED

(75) Inventors: Emily R. Parker, Goleta, CA (US); Brian J. Thibeault, Santa Barbara, CA (US); Marco F. Aimi, Menands, NY (US); Masa P. Rao, Santa Barbara, CA (US); Noel C. MacDonald, Santa Barbara, CA (US)

(73) Assignee: The Regents of the University of California, Oakland, CA (US)

( * ) Notice: Subject to any disclaimer, the term of this patent is extended or adjusted under 35 U.S.C. 154(b) by 979 days.

(21) Appl. No.: 11/537,743

(22) Filed: Oct. 2, 2006

(65) Prior Publication Data

US 2010/0125254 A1 May 20, 2010

Related U.S. Application Data

(60) Provisional application No. 60/722,461, filed on Sep. 30, 2005.

(51) Int. Cl.

| | |
|---|---|
| ***B44C 1/22*** | (2006.01) |
| ***C03C 15/00*** | (2006.01) |
| ***C03C 25/68*** | (2006.01) |
| ***C23F 1/00*** | (2006.01) |
| ***H01L 21/302*** | (2006.01) |
| ***H01L 21/461*** | (2006.01) |

(52) U.S. Cl.

USPC ..... 216/67; 216/58; 216/75; 438/689; 438/706; 438/709

(58) Field of Classification Search

None

See application file for complete search history.

(56) References Cited

U.S. PATENT DOCUMENTS

| | | | | |
|---|---|---|---|---|
| 5,952,244 | A * | 9/1999 | Abraham et al. | 438/714 |
| 6,833,079 | B1 * | 12/2004 | Giordani | 216/2 |
| 2004/0207074 | A1 | 10/2004 | MacDonald et al. | |

OTHER PUBLICATIONS

Brunette, Titanium in medicine: material science, suface science, engineering, biological responses and medical application, Springer, 2001, pp. 353-355.*

Francesco Francassi and Ricaredo d'Agostino, Chemistry of Titanium Dry Etching in Fluorinated and Chlorinate gases, 1992, Pure and Applied Chemistry, Col. 64 Vo. 5, pp. 703-707.*

Efremov et al., "Inductively coupled Cl2/Ar plasma: experimental investigation and modeling," J. Vac. Sci. Technol. A 21(4), Jul./Aug. 2003. pp. 1568-1573.

Muthukrishnan, N.M. et al., "Characterization of Titanium Etching in Cl2/N2 Plasmas," J. Electrochem. Soc., May 1997, 144(5), pp. 1780-1784.

(Continued)

*Primary Examiner* — Nadine Norton
*Assistant Examiner* — Stephanie Duclair
(74) *Attorney, Agent, or Firm* — Gates & Cooper LLP

(57) ABSTRACT

Monocyclic chlorine based inductively coupled plasma deep etching processes for the rapid micromachining of titanium substrates and titanium devices so produced are disclosed. The method parameters are adjustable to simultaneously vary etch rate, mask selectivity, and surface roughness and can be applied to titanium substrates having a wide variety of thicknesses to produce high aspect ratio features, smooth sidewalls, and smooth surfaces. The titanium microdevices so produced exhibit beneficially high fracture toughness, biocompatibility and are robust and able to withstand harsh environments making them useful in a wide variety of applications including microelectronics, micromechanical devices, MEMS, and biological devices that may be used in vivo.

19 Claims, 14 Drawing Sheets

(56) References Cited

OTHER PUBLICATIONS

O'Brien, W.L. et al., "Ion-Induced chlorination of titanium leading to enhanced etching," J. Chem. Phys., 89(8), Oct. 15, 1988, pp. 5264-5272.
O'Mahony, C. et al., "Titanium as a micromechanical material," Institute of Physics Publishing, Journal of Micromechanics and Microengineering, 12, 2002, pp. 438-443.
Parker, E.R. et al., "Inductively Coupled Plasma Etching of Bulk Titanium for MEMS Applications," Journal of the Electrochemical Society, 152(10), 2005, pp. C675-C683.
Rangelow, I.W. et al., "Reactive ion etching for microelectrical mechanical system fabrication," J. Vac. Sci. Technol. B 13(6), Nov./Dec. 1995, pp. 2394-2399.
Reeves, R.R. et al., "A Diagnostic Approach to Plasma-Etching Kinetics: Determination of Atom Concentrations, Journal of the Electrochemical Society," 137(11), Nov. 1990, pp. 3517-3522.
S.M. Spearing, "Materials Issues in Microelectromechanical Systems (MEMS)", Acta Mater, 48, 179, 2000.
Marco F. Aimi et al., "High-aspect-ratio bulk micromachining of titanium", Nat. Mater., 3, 103, 2004.
D.M. Brunette et al., "Titanium in Medicine", Material Science, Surface Science, Engineering, Biological Responses and Medical Applications, p. 3-10, Springer, Berlin, 2001.
K. Blumenstock et al., "Anisotropic reactive ion etching of titanium", J. Vac. Sci. Technol. B, 7, 627, 1989.
P. Unger et al., "Application of Titanium Rie to the Fabrication of NM-Scale Structures", Microelectron. Eng., 5, 279, 1986.
R d'Agostino et al., "Dry etching of Ti in chlorine containing feeds", J. Appl. Phys., 72, 4351, 1992.
Edward M. Middlesworth et al., "ULSI Science and Technology/1995", PV 95-5, p. 246, The Electrochemical Society Proceedings Series, Pennington, NJ, 1995.
R. d'Agostino et al., "Plasma etching of Ti in fluorine-containing feeds", J. Appl. Phys., 71, 462, 1992.
Marc J. Madou, "Fundamentals of Microfabrication", p. 78-79, 103, CRC Press LLC, Boca Raton, Florida, 2002.
Stephen A. Campbell, "The Science and Engineering of Microelectronic Fabrication", p. 266-267, 514, Oxford University Press, New York, 2001.
M.J. Donachie, Jr., "Titanium: A Technical Guide", p. 13-14 ASM International, Materials Park, Ohio, 2000.
Stephen D. Senturia, "Microsystem Design", p. 69, Kluwer Academic Publishers, Boston, 2001.
D.A. Danner et al., "Reaction of atomic and molecular chlorine with aluminum", J. Appl. Phys., 59, 940, 1986.
A.M. Efremov et al., "On mechanisms of argon addition influence on etching rate in chlorine plasma", Thin Solid Films, 435, 232, 2003.
A.M. Efremov et al., "Inductively coupled Cl2/Ar plasma: Experimental investigation and modeling", J. Vac. Sci. Technol. A, 21, 1568, 2003.
Richard A. Gottscho et al., "Microscopic uniformity in plasma etching", J. Vac. Sci. Technol. B, 10, 2133, 1992.

* cited by examiner

MONOCYCLIC HIGH ASPECT RATIO TITANIUM INDUCTIVELY COUPLED PLASMA DEEP ETCHING PROCESSES AND PRODUCTS SO PRODUCED

CROSS REFERENCE TO RELATED APPLICATIONS

This application is related to the following co-pending and commonly-assigned patent applications:

U.S. Provisional Patent Application Ser. No. 60/686,409, filed on Jun. 2, 2005, by Masa P. Rao, Marco F. Aimi, and Noel C. MacDonald, entitled THREE-DIMENSIONAL MICROFABRICATION PROCESS AND DEVICES PRODUCED THEREBY; and U.S. Utility patent application Ser. No. 10/823,559, filed on Apr. 14, 2004, by Noel C. MacDonald and Marco F. Aimi, entitled METAL MEMS DEVICES AND METHODS OF MAKING SAME, now U.S. Utility Patent Application Publication Number 2004/0207074A1, published on Oct. 21, 2004, which application claims the benefit under 35 U.S.C. §119(e) to U.S. Provisional Patent Application Ser. No. 60/463,052, filed on Apr. 16, 2003;

all of which applications are incorporated by reference herein.

This application claims the benefit under 35 U.S.C. §119 (e) to U.S. Provisional Patent Application Ser. No. 60/722,461, filed on Sep. 30, 2005, by Emily R. Parker et al., entitled "MONOCYCLIC HIGH ASPECT RATIO TITANIUM INDUCTIVELY COUPLED PLASMA DEEP ETCHING AND PRODUCTS SO PRODUCED," which application is incorporated by reference herein.

STATEMENT REGARDING FEDERALLY SPONSORED RESEARCH OR DEVELOPMENT

This invention was made with Government support under Grant No. HERMIT awarded by DARPA MTO. The Government has certain rights in this invention.

FIELD OF THE INVENTION

The present invention relates in general to the filed of micromachining of bulk titanium substrates to produce devices having micro and sub-micrometer features. More particularly, the present invention relates to improved non-cyclic or monocyclic inductively coupled plasma etching processes for the rapid production of deep or high-aspect ratio micro and sub-micrometer features having smooth, vertical walls at high etch rates in titanium substrates of widely varying thickness, including titanium thin foils and films, and to devices so produced.

BACKGROUND OF THE INVENTION

Traditionally, methods for producing micro devices have relied heavily on materials such as single crystal silicon and related processes such as plasma etching used in connection with integrated circuit fabrication. However, due to the mechanical nature of some micro devices, such as microelectromechanical devices or "MEMS" having both mechanical and electrical features formed on a single substrate as well as micromechanical devices in general, the performance of such devices may be limited by the intrinsic properties of these traditional integrated circuit based silicon substrate materials. Accordingly, alternative material systems such as metals have been considered by the present inventors as potential candidates for bulk micromechanical and MEMS devices because the relative ductility and other properties of metal substrates such as titanium can reduce the risk of failure associated with brittle silicon substrates and harsh environments including biological systems.

Earlier developments by the present inventors provided cyclic metal anisotropic reactive ion etching with oxidation methods, referred to as "MARIO" processes, for the production of bulk titanium MEMS and other devices that require higher fracture toughness and/or resistance to harsh environments than can be provided by traditional silicon based substrate materials. The MARIO processes are discussed in detail in co-pending U.S. Utility patent application Ser. No. 10/823,559, filed on Apr. 14, 2004, by Noel C. MacDonald and Marco F. Aimi, entitled METAL MEMS DEVICES AND METHODS OF MAKING SAME, now U.S. Utility Patent Application Publication Number 2004/0207074A1, published on Oct. 21, 2004, which application claims the benefit under 35 U.S.C. §119(e) to U.S. Provisional Patent Application Ser. No. 60/463,052, filed on Apr. 16, 2003, both of which applications are incorporated herein by reference. In addition to their relative fracture toughness and resistance to harsh environments, titanium based micro devices and MEMS have excellent biocompatibility due to the biocompatibility of titanium itself and show promise for use in vivo applications.

Outside of the earlier work of the present inventors, the majority of prior art research on titanium dry etching (i.e. plasma-based etching) practiced by others of skill in the art has been performed on thin films deposited on conventional semiconductor substrates (e.g. silicon, glass, etc), in which the primary functionality of the thin film was electrical rather than mechanical in nature. In general, these alternative prior art processes rely upon known fluorine- and/or chlorine-based chemistries to etch titanium thin films. Gases known in the art to be suitable for thin film titanium etching utilizing such prior art processes include: $CCl_4/O_2$ with additions of fluorine containing gases, $CCl_4/CCl_2F_2$ with admixtures of $O_2$, $Cl_2/BCl_3$; $Cl_2/N_2$, $CF_4$, $CF_4/O_2$, $SiCl_4$, $SiCl_4/CF_4$, and $CHF_3$, $CF_4/O_2$, and $SF_6$.

Although it is known in the art that micromechanical structures dry etched into titanium thin films have been demonstrated, and that the etched titanium thin films so produced can be used in microelectronics, realization of high aspect ratio structures (i.e. structures with heights far greater than their width) with such techniques is significantly limited due to film thickness limitations imposed by the deposition processes (generally 10 micrometers). Furthermore, such techniques are also often hampered by the detrimental residual stresses that can arise in these deposited thin films, which serve to distort and deform the structures once they are released from the constraint of the substrate below. High aspect ratio structures are desired in micromechanical applications for a number of reasons, including: a) to provide stiffness in the out-of-wafer plane direction to enhance structural robustness and durability, and to enable fabrication of large suspended structures that would be difficult if not impossible to realize with low aspect ratio thin film structures; b) to provide greater vertical surface area for high force capacitive actuation and enhanced sensing in MEMS actuators and sensors; and c) to provide greater mass for enhanced sensitivity in acceleration sensors. Accordingly, thin film titanium micro devices produced through the prior art techniques are generally unable to provide the functionality required for many micromechanical applications. Therefore, many are less than desirable for actual use outside or research relative to their silicon counterparts.

It is also known in the art that wet chemical and electrochemical-based etching methods have been demonstrated for fabrication of titanium-based micromechanical structures. In these techniques structures are generally etched into bulk titanium metal substrates rather than thin deposited films, thus enabling fabrication of structures with greater structural height. However, the aspect ratios that can be achieved using these techniques are also limited, due to the isotropic nature of the etching processes. This isotropy, characterized by similar rates of etching in all directions, causes undercutting of the masking materials which therefore precludes the fabrication of thin, high aspect ratio structures. This undercutting also prevents direct transferal of the mask features into the substrate therefore constraining the types of features and geometries that can be produced. Finally, undercutting also constrains the structural complexity that can be achieved because neighboring features must be spaced far enough apart to ensure that the desired etch depth will be achieved before the lateral undercutting undermines the etched structures. Such undercutting is also common in dry etching of bulk titanium substrates, which therefore provided the impetus for the development of the cyclic etch/passivation MARIO processes described earlier.

There are additional drawbacks in these earlier titanium etching processes that have further reduced the ability of such known titanium microdevices and MEMS to become competitive alternatives to traditional silicon-based devices. For example, as successful as the MARIO processes are at producing high aspect ratio titanium microdevices, they do so rather slowly. This is because of the relatively low etch rates provided by the MARIO processes resulting from their reliance upon cyclic, alternating protective oxidation steps sandwiched between reactive etching steps, in order to prevent isotropic lateral undercutting. In addition, there are rate limiting aspects inherent in the parallel plate, capacitively coupled plasma systems used in the MARIO processes.

Accordingly, there is a need in the art for improved bulk titanium etching and deep etching processes that will effectively produce high etching rates in titanium substrates of varying thickness for the fabrication of highly functional, robust, reliable, and even biocompatible, titanium-based devices composed of high aspect ratio micro-structural features with vertical sidewalls and smooth surfaces.

SUMMARY OF THE INVENTION

These and other objects are achieved by the present invention which provides monocyclic deep etching processes for the rapid micromachining of titanium substrates having a wide variety of thicknesses to produce high aspect ratio features and acceptably smooth surfaces on novel titanium microdevices, micromechanical devices, and microelectromechanical devices or "MEMS". These titanium microdevices produced in accordance with the teachings of the present invention have beneficially high fracture toughness, are robust and able to withstand harsh environments, and are biocompatible. As a result, they are useful in a wide variety of applications including electronics, micromechanical devices, MEMS, microdevices in general, and biological devices that may be used in-vivo.

In contrast to the prior art, the present invention provides novel methods for the rapid, bulk production of titanium MEMS and other microdevices having high aspect ratio surface features that are competitive alternatives to traditional silicon based devices. Further, in addition to the high titanium etch rates provided by the present invention, these novel processes significantly reduce the problem of undercutting patterned maskworks and side wall scalloping while retaining the desired characteristics of high aspect ratio and high titanium oxide ("$TiO_2$") mask selectivity by simultaneously reducing the etch rate of $TiO_2$ while providing increased titanium etch rates and surface smoothness.

In a broad aspect, the methods of the present invention are chlorine based micromachining methods developed from inductively coupled plasma etching technology, known in the art as ICP. In contrast to the multiple gas etching compositions of the art, the methods of the present invention do not require the more complex and exotic gas chemistries or the alternating oxidizing protecting and then etching steps known in the art. Hence, the methods of the present invention are easier to optimize to the variations and idiosyncrasies of different ICP systems, devices and equipment, even the functional differences between identical machines from the same manufacturer. Those skilled in the art will appreciate that these differences have significantly complicated and slowed the adaptability of prior art etching processes to existing hardware and machines.

The present inventors have coined the term "TIDE", to identify and distinguish their new high aspect ratio rapid etch chlorine based titanium micromachining methods from earlier etching processes. Their term "TIDE" being an acronym for "titanium ICP deep etch process". Generally put, the TIDE processes of the present invention all include the basic step of inductively coupled plasma etching of a masked and patterned titanium substrate with chlorine gas at a source power ranging from about 100 W to 800 W, an applied rf sample power or "bias" ranging from about 50 W to 400 W, a pressure ranging from about 0.5 Pa to 4.0 Pa, a chlorine gas flow rate ranging from about 20 sccm to 100 sccm, and a gas composition ranging from about 50% to 100% chlorine.

As those skilled in the art will appreciate from the teachings of the present invention, it is possible to vary these inventive parameters within the teachings of the present invention to achieve maximum available titanium etch rates within the capacity of the etching system utilized to practice the present invention. Similarly, it also is possible to vary these ranges to maximize surface smoothness in conjunction with high etch rates.

Further, it is within the teachings of the present invention to add argon ("Ar") gas to the chlorine plasma. Adding an inert gas such as argon to the chlorine gas in accordance with the teachings of the present invention can stabilize the plasma while varying the etch rate to both increase or decrease the etch rate, as desired, while modifying surface smoothness or $TiO_2$ etch rate.

A further advantage of the present invention is that those skilled in the art also will be able to vary these inventive parameters to reduce undercutting the patterned $TiO_2$ mask work while maintaining high etch rates and surface smoothness on the micro devices so produced. For example, the parameters of the present invention can be varied to maximize the titanium etch rate at a high available level, depending on the ICP system used, while maintaining a high $TiO_2$ mask selectivity through manipulation of the ICP source power to reduce the etch rate of the mask layer etch.

Because the present invention provides methods for the rapid bulk production of high aspect ratio titanium microdevices having accurately etched vertical walls, deep channels, and smooth surfaces, the present invention also provides previously unobtainable titanium microdevices that are particularly well suited for a variety of uses. For example, in accordance with the teachings of the present invention titanium metal substrates can be patterned and etched to provide microchannels for fluid conduction and management. These etched substrates can be laminated together with other substrates to form devices and structures including closed channels and chambers having accurately defined internal dimensions and volumes.

As a result, microdevices such as titanium microneedles can be produced with the present invention as well as other titanium microdevices incorporating micro-mixing chambers, separators, reaction chambers, sensors, and the like. Those skilled in the art will appreciate that such devices can not be produced with any predictability from etched titanium films and foils using prior art techniques.

In contrast to the prior art, the present invention provides novel methods for the bulk production of titanium microneedles, MEMS, and other micro-devices and structures that are a competitive alternative to traditional silicon based devices for uses that require higher fracture toughness and/or resistance to harsh environments. Additionally, given titanium's excellent biocompatibility, the titanium devices produced through the methods of the present invention are suitable as substrates for in-vivo and other biological applications.

Other features and advantages of the present invention will become apparent to those skilled in the art from the following detailed description, taken in conjunction with the accompanying figures, graphs, and high resolution scanning electron micrographs which illustrate, by way of example, the principles of the present invention.

DETAILED DESCRIPTION

Figure 1:
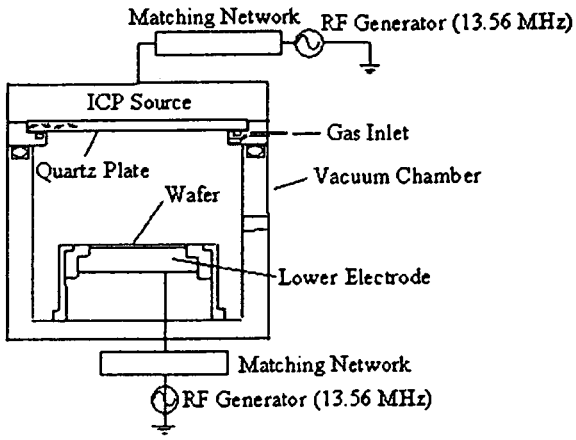
FIG. 1 is a design schematic of an exemplary Panasonic E640-ICP dry etching system used to illustrate the principles of the present invention. A quartz plate with an ICP source is located above an aluminum vacuum chamber facing a 6 inch carrier wafer. Two RF power sources (13.56 MHz) are applied to the ICP source and the lower electrode through a matching network. The sample carrier wafer is held to the lower electrode by an electrostatic chuck. Temperature is controlled through a helium cooling system applied to the backside of the carrier wafer.

The present invention provides monocyclic chlorine based bulk titanium dry etching methods or processes using an inductively coupled plasma or "ICP" source to rapidly deep etch titanium substrates of varying thicknesses ranging from 10 μm to 500 μm or more to produce high aspect ratio micromachined titanium structures having smooth vertical sidewalls and deep floors with minimal surface roughness. In accordance with the teachings of the present invention, the ICP source power, sample RF power, process pressure, and gas composition can be varied within defined ranges to simultaneously maximize one or more of the inventive methods' characteristics including the titanium etch rate, the $TiO_2$ mask etch rate or "mask selectivity", and the surface roughness of the finished titanium part. Utilizing the teachings of the present invention, bulk titanium etch rates in excess of 2 μm/min with high mask selectivity (40:1, Ti:$TiO_2$) are possible. Additionally, the present invention provides previously unattainable titanium bulk micromachining capabilities providing novel titanium-based microdevices including micromechanical devices such as microneedles and microelectromechanical or "MEMS" devices.

The titanium microdevices produced in accordance with the teachings of the present invention have beneficially high fracture toughness, are robust and able to withstand harsh environments, and are biocompatible. As a result, they are useful in a wide variety of applications including microelectronics, micromechanics, MEMS devices, and biological devices that may be used in-vivo.

The methods of the present invention have been identified by present inventors utilizing the coined term "TIDE", to distinguish their high aspect ratio rapid etch chlorine based titanium micromachining methods from earlier etching processes including their own "MARIO" method. Their term "TIDE" is an acronym derived from the descriptive title "titanium ICP deep etch process". In a broad aspect, the TIDE processes include the basic step of inductively coupled plasma etching a masked and patterned titanium substrate with chlorine gas at a source power ranging from about 100 W to 800 W, an applied rf sample power or "bias" ranging from about 50 W to 400 W, a chamber pressure ranging from about 0.5 Pa to 4.0 Pa, a chlorine gas flow rate ranging from about 20 sccm to 100 sccm, and a gas composition ranging from about 50% to 100% chlorine. To vary the gas composition an inert gas such as argon can be added. Furthermore, unlike the MARIO process and other prior art etching processes, the TIDE process of the present invention is non-cyclic or "monocyclic" and does not rely on alternating oxidative protection steps sandwiched between etching steps, thus the etched sidewalls are smoot and scallop-free.

A more detailed understanding of the methods of the present invention and their adaptable beneficial process characteristics will be provided to those skilled in the art from the following discussion of exemplary embodiments of the preset invention.

Two different exemplary titanium material types were used for these experiments. Commercially pure Grade 1 titanium sheets with a polished finish (Tokyo Stainless Grinding Co., Ltd, Tokyo, Japan) approximately 500 μm thick were purchased and used for the etch characterizations and high aspect ratio etching. These substrates were sectioned into 2.5×2.5 $cm^2$ samples using a mechanical shearing tool (24" Bench-Top Square Cut Shears, McMaster-Carr, Los Angeles, Calif.)). It should be noted that the present invention could also utilize full wafer substrates as well. The exemplary case presented herein used smaller substrates for the sake of economy of the material.

For the thin-foil etching experiments titanium thin foils (2.5×2.5 $cm^2$, 99.6% annealed, Goodfellow Corporation, Devon, Pa.) were purchased and used. These foils ranged in thickness from 10 μm to 100 μm and utilized chemical mechanical polishing (MultiPrep System, Allied High Tech Products, Inc., Rancho Dominguez, Calif.) prior to lithography.

All titanium samples were cleaned in acetone and isopropanol with ultrasonic agitation in preparation for etch processing with the inventive TIDE methods. In accordance with the teachings of the present invention, the general bulk titanium process flow included the following steps: 1) $TiO_2$ mask deposition; 2) photolithographic patterning; 3) mask oxide etching; 4) and titanium deep etching. The oxide etches and titanium deep etches were both performed using the same exemplary ICP etch tool (Panasonic E640-ICP dry etching system, Panasonic Factory Solutions, Osaka, Japan), which is shown schematically in FIG. 1. It should be emphasized that other manufacturers' etch tools are contemplated as being within the scope of the present invention.

Each of the titanium samples was mounted on a 6-inch silicon carrier wafer using diffusion pump fluid (Santovac 5, polyphenyl ether pump fluid, Santovac Fluids, Inc., St. Charles, Mo.), which was used to create thermal conductivity between the carrier wafers and the samples. Such attachment was necessary to provide compatibility with the wafer-based etch tool. It should be noted that full-wafer substrates would not require such carriers and could be used directly in the tool. The lower electrode of the exemplary etching tool was held constant at 20° C., although the lower electrode temperature range can vary from −20° C. to +70° C. without departing from the scope of the present invention, and helium backside cooling at 400 Pa was used to maintain constant carrier wafer temperature during all etches.

In each case, a $TiO_2$ etch mask was deposited on the samples using reactive sputtering (Endeavor 3000 cluster sputter tool, Sputtered Films, Santa Barbara, Calif.) with the titanium targets in an $O_2$/Ar environment using the following process conditions: 10 sccm $O_2$, 20 sccm Ar, and 2300 W power. The process pressure was approximately 5.2 mT. Each sample was sputtered for 4500 s, resulting in an average film thickness of 1.25 μm. Features were then patterned onto the $TiO_2$ mask using 3 μm thick photoresist (SPR 220-3.0, Shipley, Marlborough, Mass.).

The photoresist patterns were transferred into the oxide layers using a $CHF_3$ chemistry under the following conditions: 500 W ICP source power (13.56 MHz), 400 W sample RF power (13.56 MHz), 1 Pa pressure, and 40 sccm $CHF_3$. Each sample was etched for 10 min, removed from the carrier wafer, and then cleaned in acetone and isopropanol with ultrasonic agitation. The remaining fluorinated photoresist on each sample was removed using an $O_2$ plasma (PEII-A Plasma System, Technics) under the following conditions: 300 mT pressure, 100 W power. After cleaning, each of the patterned samples was remounted onto a silicon carrier wafer for the titanium deep etch.

For these exemplary process characterization etches, each sample was etched in an exemplary $Cl_2$/Ar chemistry for 2 min with a specified parameter set in accordance with the teachings of the present invention. Only a single parameter was varied for each exemplary etch to illustrate the principles of the present invention. Unless otherwise stated, all other parameters were held constant at the following exemplary values: 400 W ICP source power (13.56 MHz), 100 W sample RF power (13.56 MHz), 2 Pa pressure, 100 sccm $Cl_2$, and 5 sccm Ar. Etch depths ranged from approximately 0.5 to 4.7 μm over the chosen parameter space. The high aspect ratio etching and titanium thin-foil etching were performed using longer etch times at parameters within the tested parameter space.

For the exemplary samples, etch depth and mask thicknesses were measured using a high-resolution scanning electron microscope (FEI XL40 Sirion FEG Digital Scanning Microscope, FEI, Hillsboro, Oreg.). Measurements were taken on 1.5 μm wide lines imaged at a 45° tilt angle at five random locations across the sample and averaged. These values were then compared to measurements taken using a contact stylus profilometer (Dektak IIA profilometer, Sloan) to ensure consistency.

Average surface roughness measurements were also taken using an optical profilometer (Wyko NT 1100, Veeco Instruments, Inc., Woodbury, N.Y.). Measurements were made over a large exposed area (approximately 400×600 $\mu m^2$) at five random locations across the sample and averaged. These measurements showed as-received surface roughness levels of between 5 and 10 nm RMS for the thick polished substrates. Titanium etch rate, $TiO_2$ etch rate, and surface roughness data were plotted to illustrate first order trends for each etch parameter. These trends were then used to optimize the TIDE processes. The high aspect ratio etching and thin-foil etching of bulk titanium followed the same general process flow used by the etch characterization runs. Each of the variable process parameters and resultant variable etching characteristics of the present invention are discussed as follows to illustrate to those of ordinary skill in the art how the methods of the present invention enable the simultaneous optimization of multiple process characteristics and outcomes to produce previously unobtainable titanium devices with high aspect ratio etching, smooth sidewall surfaces, and reduced surface roughness.

ICP Source Power

It is understood by those of skill in the art that plasma-assisted dry etching is a combination of both physical etching through ion bombardment and chemical etching through reactive species interactions at the substrate surface. Complete decoupling of these two etching mechanisms is difficult and the relative contributions of each can vary significantly with etch conditions. Throughout the dry etching process, the substrate surface is subjected to an incident flux of ions, radicals, electrons, and neutrals. In general, the physical processes are controlled by the ion flux and the chemical processes are controlled by both the ion and radical flux. It is known in the art that titanium etching relies more heavily on chemical processes, while $TiO_2$ etching is more dependent on physical etching. Consequently, it is believed that titanium etching is driven by chemical mechanisms and reactive species availability, whereas $TiO_2$ etching is affected more by ion bombardment. This understanding of basic etching principles will assist in understanding the methods of the present invention.

Figure 2:
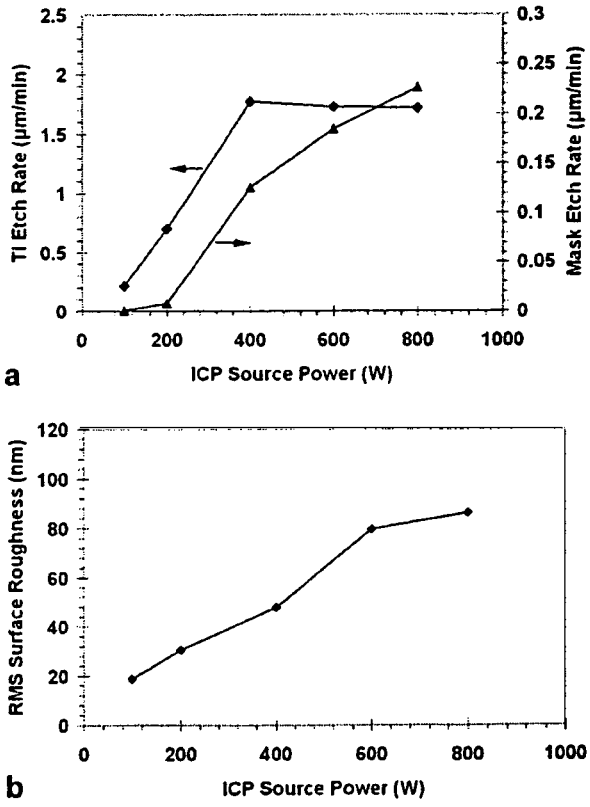
FIG. 2 presents two graphical plots illustrating the principles of the present invention and showing (a) the bulk titanium and $TiO_2$ mask etch rates and (b) the root mean square ("RMS") of surface roughness as a function of ICP source power for an exemplary 2 minute etch time while the remaining parameters were held constant at 100 W RF sample power, 2 Pa, 100 sccm $Cl_2$, and 5 sccm Ar.

In accordance with the teachings of the present invention, the bulk titanium etch rate as a function of ICP source power is shown in FIG. 2(*a*). As shown in FIG. 2, the etch rate increases appreciably with source power initially and then levels off for powers above 400 W. Understanding that the chlorine-based etching mechanism associated with the etching of bulk titanium is chemically similar to that of titanium thin film etching discussed in the literature, titanium tetrachloride $TiCl_4$ is the most volatile etch compound with a boiling temperature of 136.4° C. However, both $TiCl_4$ and $TiCl_2$ (boiling temperature=1327° C.) have been detected as reaction products. As molecular $Cl_2$ is introduced into the discharge, a percentage will be ionized or dissociated into atomic Cl. Increased source power will lead to an increase in this ionization and dissociation, resulting in higher ion and radical densities.

Below 400 W, it is believed that the etching of bulk titanium is most likely ion and radical limited, resulting in a decrease in overall chemical reaction and etch rate. As the reactive species density is increased with increasing power the etch rate will also increase. For values above 400 W, the ionization and dissociation of chlorine is no longer the limiting factor. In this range it is believed that the etch rate is most likely controlled by other processes, such as the supply rate of the reactive chlorine species, the reactive species transport rate to the substrate surface, or the chemical reaction rate at the surface. This causes the etch rate of the present invention to remain constant for values above 400 W if all other parameters are held constant.

Figure 3:
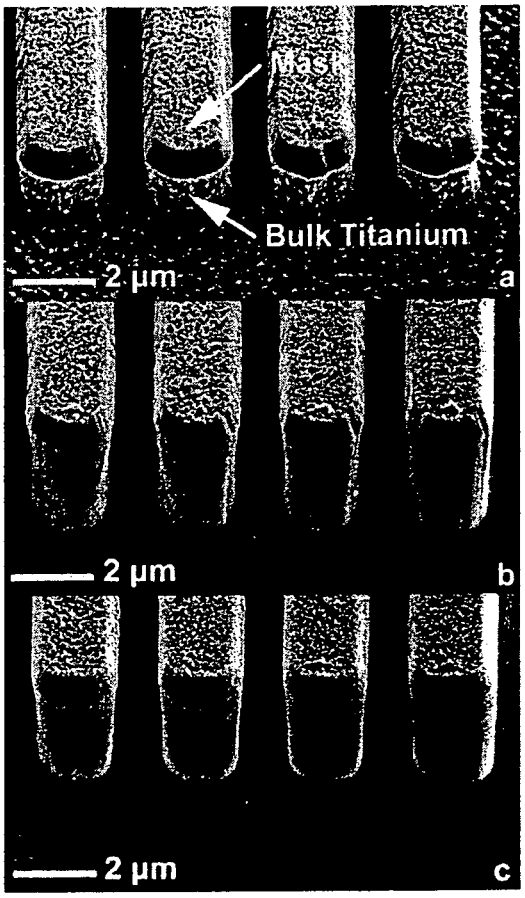
FIG. 3 compares three scanning electron micrographs, taken at a 45° tilt, illustrating the principles of the present invention and showing features etched at various ICP source powers for exemplary 2 minute etch times: (a) 200 W, (b) 400 W, and (c) 600 W, while the remaining parameters were held constant at 100 W RF sample power, 2 Pa, 100 sccm $Cl_2$, and 5 sccm Ar.

ICP source power also influences the quality of the etched feature surface. As shown in FIG. 3, source power affects both the roughness and overall shape of the etched features. For lower source power, i.e. 200 W, the resultant etch appears to be more isotropic, leading to a slight undercutting of the $TiO_2$ masking layer. This lower power also results in microscopic roughness on all exposed titanium surfaces, attributed to a higher chemical etch component. As source power is increased to 400 W incident ion flux increases, which results in reduced sidewall and floor roughness. Increasing the source power to 600 W does not increase etch rate considerably, however it does further reduce sidewall and floor roughness. We also believe that higher ICP source power may improve the verticality of the etch, however this is a difficult conclusion to make completely from low aspect ratio features such as those shown in FIG. 3.

The $TiO_2$ etch rate as a function of ICP source power within the teachings of the present invention is also shown in FIG. 2(*a*). The etch rate increases only slightly between 100 W and 200 W but then increases drastically for values above 200 W. This results in a decrease in overall $TiO_2$ mask selectivity. At lower powers, in accordance with the teachings of the present invention the ion concentrations and energies are lower thereby reducing ion bombardment. As the source power is increased the incident ion flux increases, which will in turn increase the $TiO_2$ etch rate. Therefore, the present invention provides a trade-off allow an adjustable balance between increasing the titanium etch rate and maintaining high $TiO_2$ mask selectivity through manipulation of ICP source power.

Figure 4:
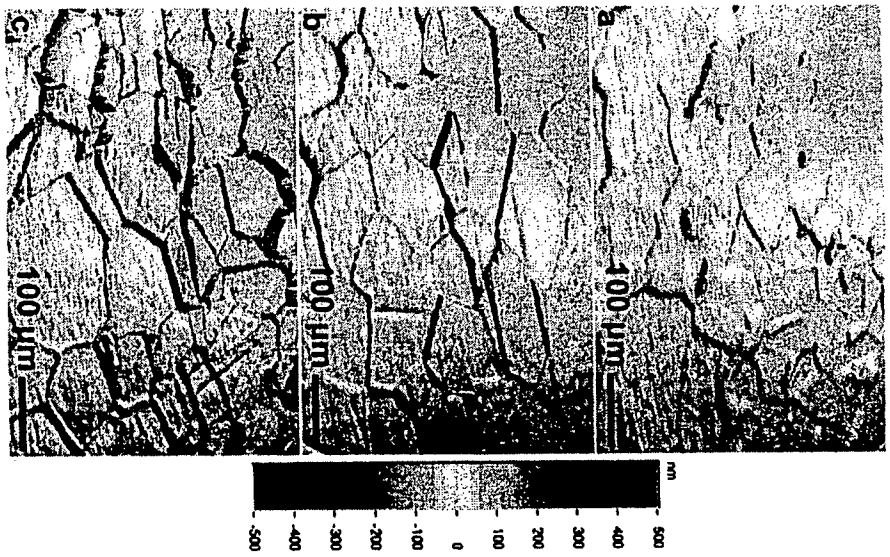
FIG. 4 illustrates the principles of the present invention by comparing three, 3-dimensional surface profiles measured using phase shift interferometry of bulk titanium following exemplary 2 minute etch times at various ICP source powers utilizing the teachings of the present invention: (a) 200 W, (b) 400 W, and (c) 600 W, while the remaining parameters were held constant at 100 W RF sample power, 2 Pa, 100 sccm $Cl_2$, and 5 sccm Ar. The measured region is approximately 400×600 $\mu m^2$.

Optical profilometry was used to study the resulting surface roughness following each characterization etch of the present invention. This technique allowed for the measurement of large surface areas (400×600 $\mu m^2$) comparable to typical MEMS device dimensions. Root mean square (RMS) surface roughness as a function of ICP source power in accordance with the teachings of the present invention is shown in FIG. 2(*b*). RMS surface roughness ($R_{RMS}$) increases with increasing ICP source power. This increase can be attributed to roughening at both the global and local scales, as shown in FIG. 4.

The thick titanium substrates used for each of the etch characterization are polycrystalline in nature, with grain sizes on the order of ~100 μm. Differential etching of these grains, presumably due to preferential etching of certain crystallographic orientations, increases roughness on the global scale. Therefore, utilizing the teachings of the present invention, as the ICP source power is increased from 200 W to 400 W, the variation in etch depth between various grains is increased, leading to an overall increase in $R_{RMS}$. As the ICP source power is further increased to 600 W, additional features can be seen along the grain boundaries. It should be appreciated by those skilled in the art that these features often cause micro-masking during longer etches and may be caused by the localization of impurities during the titanium sheet production process.

Though the aforementioned global roughness due to grain structure and boundaries will more strongly affect the quality of a typical titanium MEMS device, local roughness can also be assessed qualitatively using the same measuring techniques and measurements. For example, in accordance with the teachings of the present invention, increasing ICP source power also causes a slight increase of local roughness within the titanium metal grains themselves. This local roughness is at a smaller length scale than the aforementioned global roughness but should not be confused with the microscopic roughness seen in FIG. 3(*a*). This microscopic roughness cannot be addresses at this point because it most likely is below the discernable length scale for the tool and exemplary set-up being used.

An increase in local roughness was made more apparent with the application of a high pass digital filter using a Fast Fourier Transform (FFT) to filter surface roughness data with spatial frequency below 10 μm. Application of this filtering to the roughness measurements of the surfaces shown in FIG. 4 at 400 W and 600 W ICP source power yielded $R_{RMS}$ values of roughly 5 nm and 10 nm, respectively. This suggests that, with the teachings of the present invention, the average local roughness at 600 W ICP is twice that at 400 W. Similarly, if the FFT filter is applied to the roughness measurement for an etch with 800 W ICP source power, the resultant RMS value is ~25 nm, 5 times higher than the value at 400 W. The data filtering therefore confirms the teachings of the present invention that increased ICP source power produces increased local roughness, as the surface profiles in FIG. 4 show. This, in combination with an increase in global roughness, most likely contributes to the increase in overall surface roughness associated with higher ICP source powers.

RF Sample Power

The applied RF sample power, or bias, controls the incident ion energy on the surface of the substrate. In accordance with the teachings of the present invention, FIG. 5(*a*) shows the bulk titanium etch rate as a function of RF sample power within the defined parameters. The titanium etch rate increases slightly with increasing bias from 50 W to 100 W but then remains relatively constant for values above 100 W. As mentioned previously, it has been reported that titanium etching is more dependent on chemical processes than ion bombardment. However, it is likely that energetic ions partially assist the removal of material from the substrate surface. Therefore, for bias values below 100 W, the level of incident ion energy may limit the titanium etch rate. For values above 100 W, ion bombardment is no longer the limiting factor and the titanium etch rate is most likely dependent on other factors controlling chemical processes within the plasma. This causes the etch rate to remain constant for bias values above 100 W if all other parameters are held constant within the teachings of the present invention.

Figure 6:
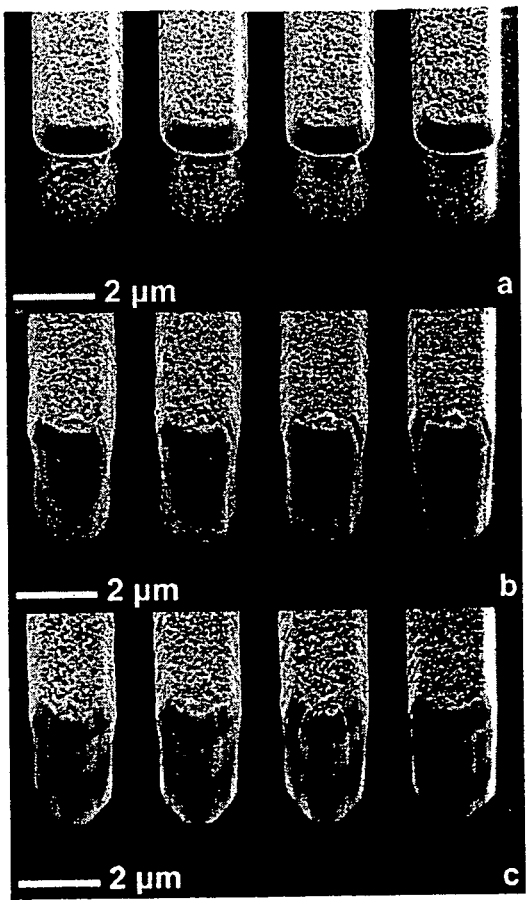
FIG. 6 illustrates the principles of the present invention by comparing scanning electron micrographs, taken at a 45° tilt, showing features etched at various RF sample powers during exemplary 2 minute etch times: (a) 50 W, (b) 100 W, and (c) 200 W, while the remaining parameters were held constant at 400 W ICP source power, 2 Pa, 100 sccm $Cl_2$, and 5 sccm Ar.

Further, when compared to variations in ICP source power, RF sample bias has much less effect on the titanium etch rate of the present invention for the exemplary values. Varying the sample bias only resulted in changes in etch rate in the range of 0.5 μm/min. However, similar to ICP source power, variations in RF sample power did strongly influence the microscopic roughness of the exposed titanium surfaces. As shown in FIG. 6, as sample bias is increased from 50 W to 200 W the resultant etch become more anisotropic. In particular, the sidewalls associated with sample bias of 50 W are extremely rough and show undercutting of the $TiO_2$ mask. However, unlike the etched features associated with lower ICP source powers (refer to FIG. 3(*a*)), the resulting feature roughness at this low sample bias is very apparent on the sidewalls but does not appear on the etched floors. Therefore, the etch appears to be less chemical and more directional at this low sample bias than in the case of low ICP source power, i.e. 200 W, where the entire surface showed microscopic roughness. As sample bias is increased to 200 W virtually all roughness on the sidewalls is removed and the resulting features are smooth. Additionally, there also may be improvement in the verticality of the etched features though, again. However, this is difficult to confirm from the low aspect ratio features such as those shown in FIG. 6.

Figure 5:
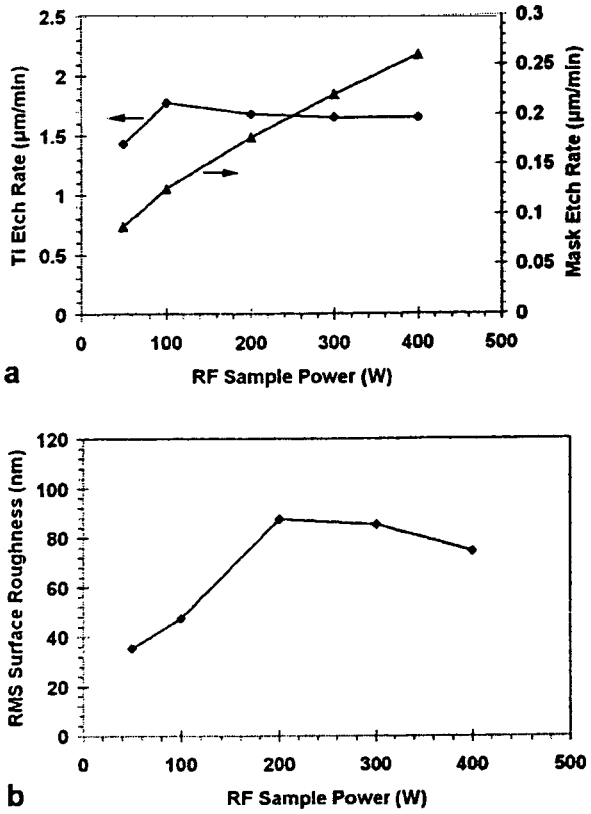
FIG. 5 presents two graphical plots illustrating the principles of the present invention and showing (a) the bulk titanium and $TiO_2$ mask etch rates and (b) the RMS surface roughness as a function of RF sample power during an exemplary 2 minute etch while the remaining parameters were held constant at 400 W ICP source power, 2 Pa, 100 sccm $Cl_2$, and 5 sccm Ar.

Variations in RF sample power were found to have only a small effect on the titanium etch rate. However, RF sample power did strongly affect the $TiO_2$ mask selectivity. As sample bias is increased from 50 W to 400 W, the $TiO_2$ mask etch rate almost triples, as shown in FIG. 5(*a*). It is believed that this is most likely due to the increase in ion bombardment energy associated with higher RF sample powers. Therefore, increasing sample bias in accordance with the teachings of the present invention will improve etch anisotropy but reduce overall $TiO_2$ mask selectivity.

The surface roughness, $R_{RMS}$, as a function of RF sample power characteristic of the present invention is shown in FIG. 5(*b*). Surface roughness increases significantly as bias increases from 50 W to 200 W. Above 200 W, $R_{RMS}$ tends to decrease slightly. An analysis was performed similar to that done for ICP source powers for bias values of 200 W and 400 W to determine the nature of this decrease in overall surface roughness. The raw data suggests that global surface roughness attributed to grain orientation and boundaries is more pronounced for a 200 W bias when compared to a 400 W bias (not shown). When a high-pass FFT filter was applied to remove data with spatial frequencies below 10 μm, the local surface roughness between the two bias values appeared roughly comparable. Therefore, surprisingly, increasing bias above 200 W in accordance with the teachings of the present invention does not further increase local roughness on the grain surfaces even though higher ion bombardment is attributed to higher bias. Instead, the higher bias appears to slightly reduce large-scale roughness associated with grain boundaries, in effect smoothing the surface.

Pressure

Figure 7:
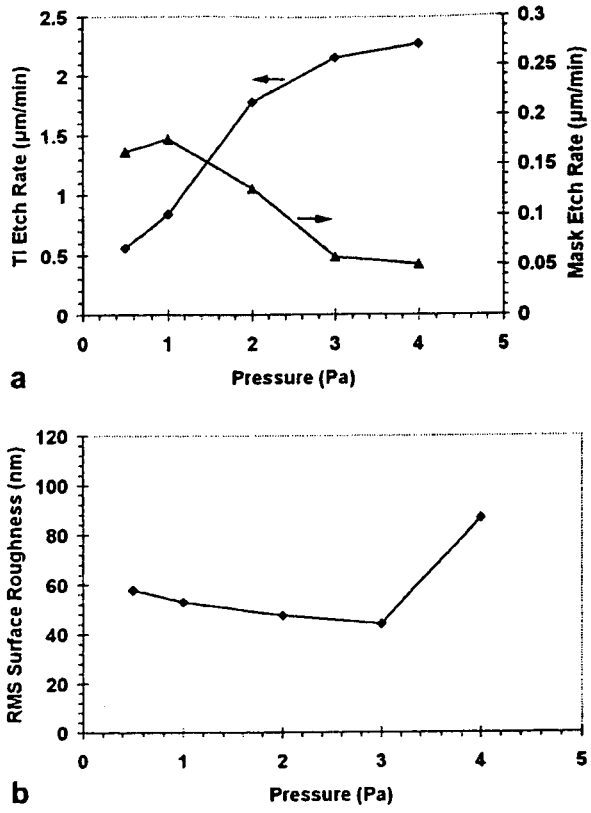
FIG. 7 presents two graphical plots illustrating the principles of the present invention and showing (a) the bulk titanium and $TiO_2$ mask etch rates and (b) the RMS surface roughness as a function of chamber pressure during exemplary 2 minute etch times while the remaining parameters were held constant at 400 W ICP source power, 100 W RF sample power, 100 sccm $Cl_2$, and 5 sccm Ar.

FIG. 7(*a*) shows the bulk titanium etch rate as a function of pressure in accordance with the teachings of the present invention. As shown, the etch rate is strongly influenced by pressure, increasing significantly from 0.5 Pa to 4.0 Pa. As pressure is increased, less directional etching associated with an increase in randomized collisions between particles occurs. In this regime, chemical effects are dominant and directional ion bombardment is reduced. This leads to an increase in titanium etch rate.

Figure 8:
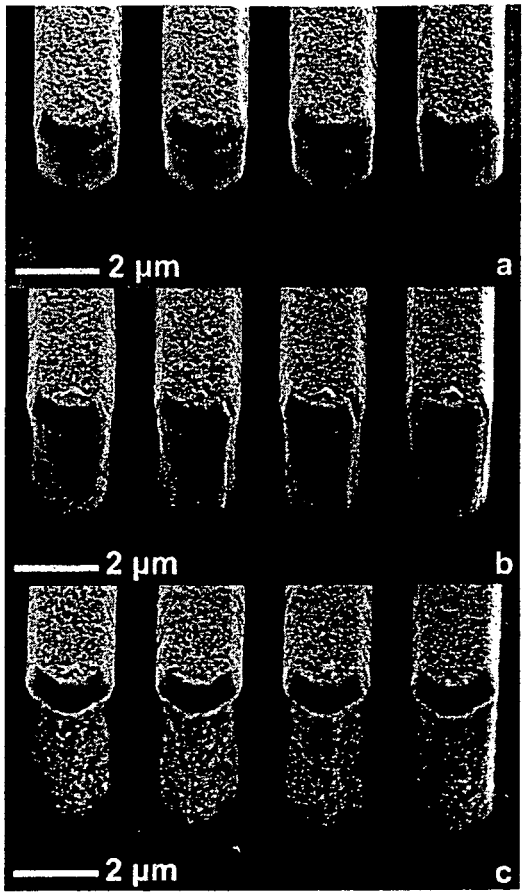
FIG. 8 compares three scanning electron micrographs, taken at a 45° tilt, illustrating the principles of the present invention and showing features etched at various chamber pressures during exemplary 2 minute etches: (a) 1 Pa, (b) 2 Pa, and (c) 3 Pa, while the remaining parameters were held constant at 400 W ICP source power, 100 W RF sample power, 100 sccm $Cl_2$, and 5 sccm Ar.

The dominance of these chemical effects is visualized in FIG. 8. As the pressure is increased from 1 Pa to 2 Pa, the images show both an increase in etch rate and also an increase in sidewall microscopic roughness. As the pressure is further increased to 3 Pa, roughness increases both on the sidewalls of the etched features as well as the floor of the substrate. At 3 Pa, there also appears to be a significant degree of mask undercutting associated with more anisotropic etch behavior. The anisotropic nature of the etch in this pressure range is most likely due to the predicted dominance of chemical processes.

The mask selectivity of the present invention or the $TiO_2$ mask etch rate as a function of chamber pressure is also shown in FIG. 7(*a*). The etch rate shows a slight increase between 0.5 Pa and 1 Pa and then proceeds to decrease between 1 Pa and 4 Pa. Above 1 Pa, the ion bombardment may be reduced due to an increase in the number of random particle collisions. This results in a decrease in the overall $TiO_2$ etch rate leading to increased mask selectivity. The $TiO_2$ selectivity changes from roughly 3:1 for a process pressure of 1 Pa to 45:1 at 4 Pa. Therefore, in accordance with the teachings of the present invention, pressure has the second largest effect on selectivity after ICP source power. However, it should be noted that higher pressure will also result in a more isotropic etch profile, as shown in FIG. 8. Therefore, a trade-off between mask selectivity and etch anisotropy must be taken into consideration when determining optimal process pressure for the deep etching of high aspect ratio features with the present invention.

Figure 9:
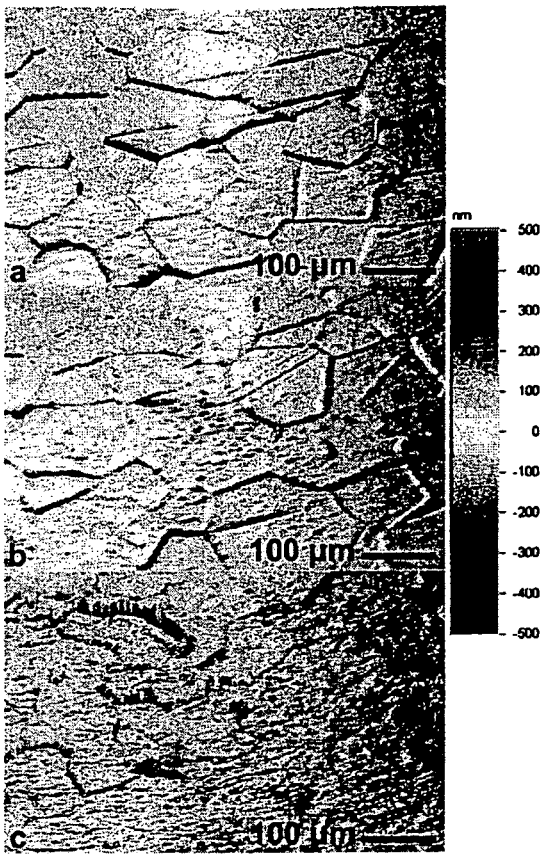
FIG. 9 illustrates the principles of the present invention by comparing three, 3-dimensional surface profiles measured using phase shift interferometry of bulk titanium following exemplary 2 minute etch times at various chamber pressures: (a) 1 Pa, (b) 2 Pa, and (c) 3 Pa, while the remaining parameters were held constant at 400 W ICP source power, 100 W RF sample power, 100 sccm $Cl_2$, and 5 sccm Ar. The measured region is approximately 400×600 $\mu m^2$.

The surface roughness $R_{RMS}$, obtained with the present invention, as a function of chamber pressure is shown in FIG. 7(*b*). Surface roughness decreases slightly from 0.5 Pa to 3 Pa and then increases significantly for a chamber pressure of 4 Pa. On a related note, FIG. 9 shows sample surface profiles for chamber pressure values of 2, 3, and 4 Pa. At 2 Pa, the surface shows nominal grain structure and local roughness. As pressure is increased to 3 Pa, global roughness due to grain boundaries and preferential grain etching decreases slightly and local roughness on the grain surfaces increases. At 4 Pa, grain structure definition is further diminished and overall local roughness is very apparent.

This overall increase in local roughness, as well as some associated grain boundary features visible in the surface profile, most likely leads to the large increase in overall $R_{RMS}$ values at this pressure. This local roughness was further quantified using the previously described filtering technique to remove roughness with spatial frequencies below 10 μm. When the raw surface data is compared for the pressures 2 Pa and 4 Pa, some increase in global roughness associated with the grain boundaries is noted at the higher pressure. However, when the data is filtered the difference in overall, local roughness is significant. Specifically, the filtered, local roughness $R_{RMS}$ value increases from roughly 5 nm at 2 Pa to 25 nm at 4 Pa. Therefore, the local roughness component of the overall $R_{RMS}$ is most likely the major cause of the surface roughness increase at 4 Pa.

Gas Composition

Figure 10:
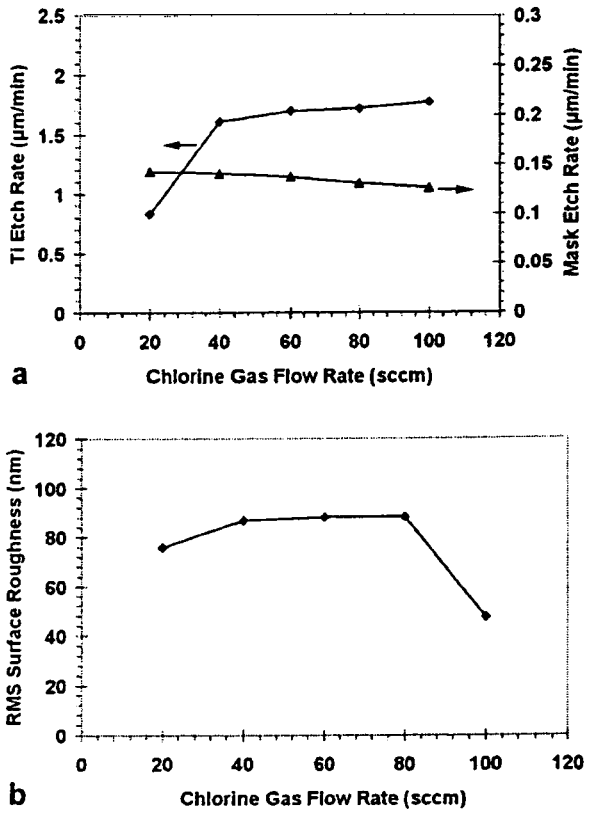
FIG. 10 presents two graphical plots illustrating the principles of the present invention and showing (a) the bulk titanium and $TiO_2$ mask etch rates and (b) the RMS surface roughness as a function of chlorine gas flow rate during exemplary 2 minute etch times while the remaining parameters were held constant at 400 W ICP source power, 100 W RF sample power, 2 Pa, and 5 sccm Ar.

FIG. 10(*a*) shows the bulk titanium etch rate of the present invention as a function of $Cl_2$ gas flow rate. The etch rate increases from roughly 0.8 to 1.8 μm/min as the $Cl_2$ flow rate is increased from 20 to 40 sccm. From 40 to 100 sccm, the etch rate remains relatively constant, increasing only slightly with increasing $Cl_2$ flow rate. It is believed that the availability of the reactant species within the plasma is determined by the rate of introduction to the discharge versus the rate of chemical reaction with the substrate. The chlorine reactant species will be introduced to the plasma through atomic dissociation and ionization of the incoming gas flow. Higher gas flow rates result in shorter molecular residence times within the plasma which will, in turn, reduce the percentage of dissociation of the incoming gas. The increase in etch rate between 20 and 40 sccm is believed to reflect limitations in reactant species availability as it is lost to chemical reactions at the titanium surface. Above this value, the plasma remains saturated with the reactant species. The etch rate in this range of $Cl_2$ flow rate remains relatively constant and may be limited instead by the reaction rate at the titanium surface or by the rate of molecular dissociation.

Figure 11:
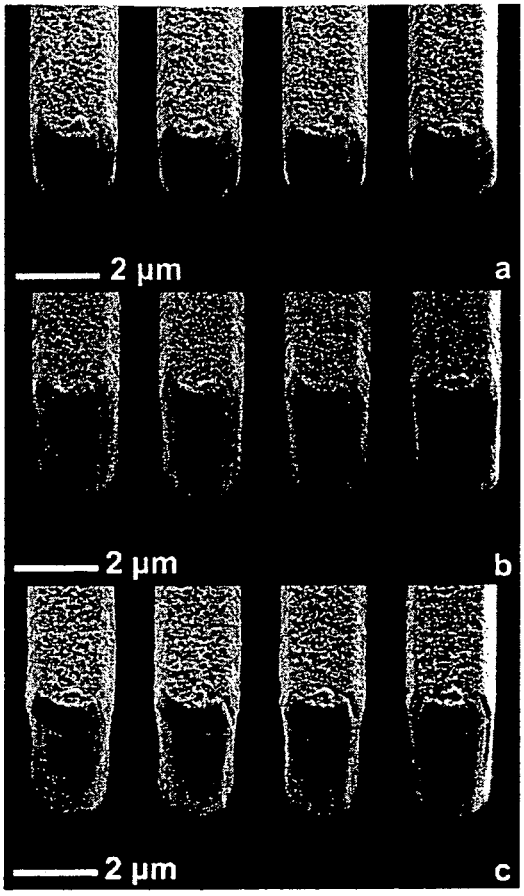
FIG. 11 illustrates the principles of the present invention by comparing three scanning electron micrographs, taken at a 45° tilt, showing features etched at various chlorine gas flow rates during exemplary 2 minute etch times: (a) 20 sccm, (b) 60 sccm, and (c) 100 sccm, while the remaining parameters were held constant at 400 W ICP source power, 100 W RF sample power, 2 Pa, and 5 sccm Ar.

Higher flow rates also result in slightly rougher feature sidewalls, as shown in FIG. 11. This Figure also illustrates the increase in etch rate as the $Cl_2$ flow rate is increased from 20 to 60 sccm. However, at both of these flow rates the sidewalls of the etched features remain smooth. As the $Cl_2$ flow rate is further increased to 100 sccm, there is little change in etch rate when compared to 60 sccm. However, microscopic sidewall roughness begins to appear at the base of the etched features. FIG. 10(*a*) also shows the $TiO_2$ mask etch rate as a function of $Cl_2$ gas flow rate. The etch rate remains relatively constant at all flow rates, decreasing only slightly from 20 to 100 sccm. Therefore, $Cl_2$ flow rate seems to have little to no effect on mask selectivity.

Figure 12:
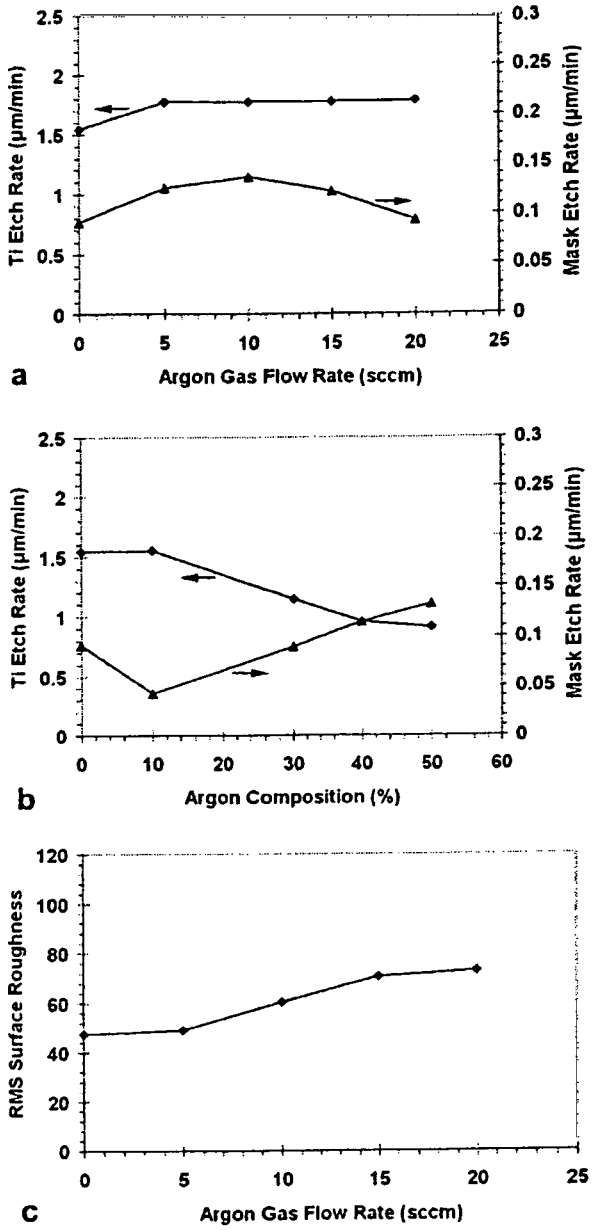
FIG. 12 presents three graphical plots illustrating the principles of the present invention and showing: (a) the bulk titanium and $TiO_2$ mask etch rates as a function of argon gas flow rate; the chlorine gas flow rate was held constant at 100 sccm, (b) the bulk titanium and $TiO_2$ mask etch rate as a function of argon composition; the overall gas flow rate was held constant at 100 sccm, and (c) the RMS surface roughness as a function of argon gas flow rate during exemplary 2 minute etch times, while the remaining parameters were held constant at 400 W ICP source power, 100 W RF sample power, and 2 Pa.

FIG. 12(*a*) shows the bulk titanium etch rate of the present invention as a function of increasing Ar gas flow rate, holding the $Cl_2$ flow rate constant at 100 sccm. The etch rate increases slightly with the introduction of Ar to the plasma but then remains relatively constant at increasing Ar flow rates. It is known that the addition of an inert gas to a discharge is often used to stabilize the plasma and/or to control etchant concentration without varying pressure. The addition of Ar to a chlorine plasma has been reported to increase etch rate under constant pressure for various materials. Several mechanisms may be responsible for this behavior, including increased $Cl_2$ dissociation through interactions with metastable Ar atoms or increased surface bombardment by energetically active species. Although a slight increase in titanium etch rate is seen with the addition of a small amount of Ar, the relative change is not significant.

Gas composition partial pressures were also manipulated in order to more broadly illustrate the effects of Ar addition on the $Cl_2$-based etching of bulk titanium. FIG. 12(*b*) shows the bulk titanium etch rate of the present invention as a function of percentage Ar, maintaining the total flow rate at 100 sccm. Initially the etch rate remains constant as Ar content is increased to 10% and $Cl_2$ content is decreased to 90%. As the Ar is further increased to 50% partial pressure, the etch rate decreases, most likely due to the decrease in overall $Cl_2$ partial pressure affecting reactive species availability. Therefore, the addition of a small amount of Ar to a $Cl_2$-based plasma seems to increase the overall bulk titanium etch rate. However, further increasing the Ar content does not appear to promote higher etch rates beyond this initial increase.

The $TiO_2$ etch rate or mask selectivity of the present invention as a function of percentage Ar composition is also shown in FIG. 12(*b*). The etch rate decreases initially as $Cl_2$ content is dropped to 90% and Ar content is increased to 10%. Above 10% Ar, the etch rate increases. This initial decrease in etch rate is not well understood at this time. However, the increasing $TiO_2$ etch rate at higher Ar partial pressures is most likely due to higher ion bombardment.

Figure 13:
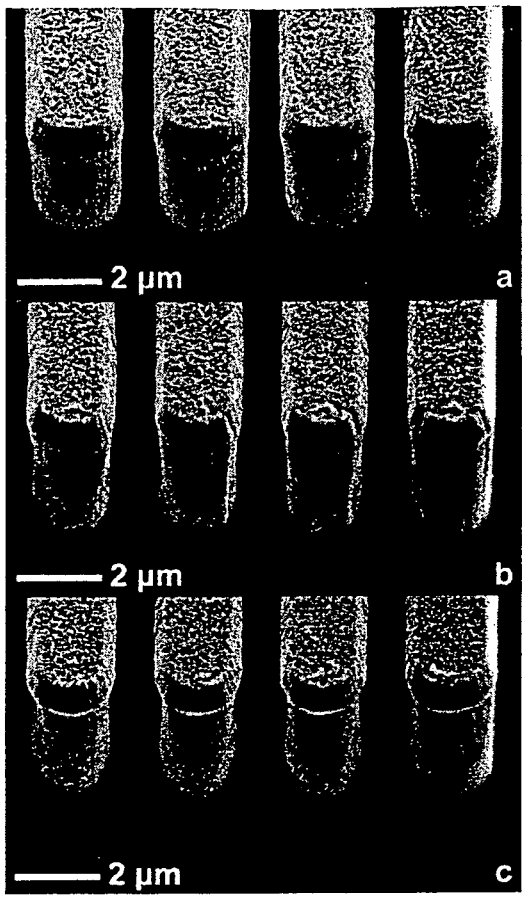
FIG. 13 illustrates the principles of the present invention by comparing three scanning electron micrographs, taken at a 45° tilt, showing features etched at various argon gas flow rates during exemplary 2 minute etch times: (a) 0 sccm, (b) 5 sccm, and (c) 10 sccm, while the remaining parameters were held constant at 400 W ICP source power, 100 W RF sample power, 2 Pa, and 100 sccm $Cl_2$.

As discussed above, if the Ar flow rate into the plasma is increased to 5 sccm while holding the $Cl_2$ flow rate constant at 100 sccm, a slight increase in etch rate is realized. In addition, if the Ar flow rate is further increased, the etch rate remains relatively constant. However, the quality of the etched features will change with higher Ar content, as shown in FIG. 13. At 5 sccm Ar flow rate, the sidewalls show some roughening at the base of the etched features. As the Ar is increased to 10 sccm, this roughness covers the entire exposed sidewall surface and a slight undercutting of the $TiO_2$ mask occurs.

The root mean square surface roughness was also measured for both $Cl_2$ gas flow rate and Ar composition. FIG. 10(*b*) shows that for $Cl_2$ gas flow rate the $R_{RMS}$ increases slightly from 20 to 40 sccm, and then remains somewhat constant from 40 to 80 sccm. The surface roughness then drops significantly from 80 to 100 sccm. Higher $R_{RMS}$ values at lower $Cl_2$ flow rates are believed to be due in part to an increase in overall Ar partial pressure at lower $Cl_2$ flow rates as the pressure is held constant. Higher Ar percentage lead to higher ion bombardment thus increasing the overall surface roughness. At 100 sccm, the etch becomes slightly more chemical and the relative Ar partial pressure is small. It is believed that this leads to the drop in $R_{RMS}$ values seen at 100 sccm. Similar $R_{RMS}$ measurements were made for Ar gas flow rate, as shown in FIG. 12(*c*). As the Ar gas flow rate is increased from 0 to 20 sccm, holding the $Cl_2$ flow rate constant at 100 sccm, the surface roughness increases steadily. Again, this is believed to be due to increasing ion bombardment associated with higher Ar flow rates.

Application to MEMS

Figure 14:
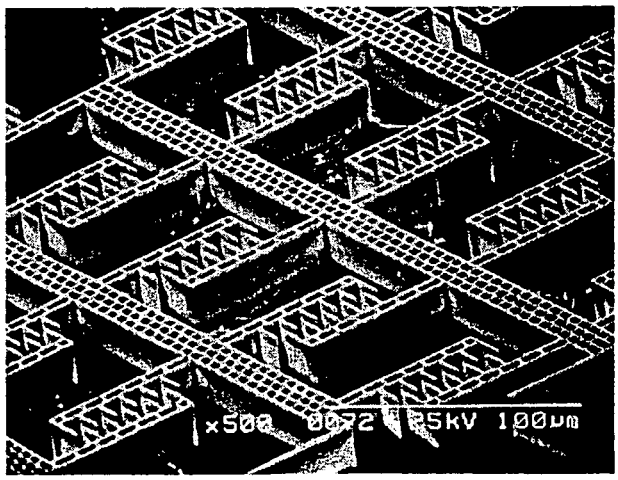
FIG. 14 illustrates the principles of the present invention by showing a scanning electron micrograph of a titanium-based MEMS comb drive structure produced with the present invention. The mask pattern was generated using optical lithography transferred to a sputtered $TiO_2$ mask via a $CHF_3$-based dry etch, and then the sample was deep etched for 10 minutes using an exemplary TIDE process with the parameters at 400 W ICP source power, 100 W sample RF power, 2 Pa pressure, 100 sccm $Cl_2$, and 5 sccm Ar. Etch depth in the open areas of the pattern is slightly in excess of 20 μm. The reduction of etch rate within the narrow vias can be seen through the thin sidewalls of the backbone structures and is indicative of RIE lag.

Based on the results of the etch characterization described above, initial baseline process conditions in accordance with the teachings of the present invention were selected for etches which resulted in greater etch depths and aspect ratios. Such features are a fundamental characteristic of many bulk micromachined MEMS devices, especially those that rely on structures with vertical sidewalls and precisely defined gaps for electrostatic actuation and sensing. FIG. 14 shows a typical MEMS comb drive structure with a minimum feature size of 1 μm etched into a thick titanium substrate using an exemplary TIDE method having process parameters (400 W ICP source power, 100 W sample RF power, 2 Pa pressure, 100 sccm $Cl_2$, and 5 sccm Ar). As shown in FIG. 14, these parameters produced TIDE etching conditions that enable the rapidly microetched definition of high-aspect-ratio structures with smooth, vertical sidewalls and well-controlled gaps in a titanium substrate.

Figure 15:
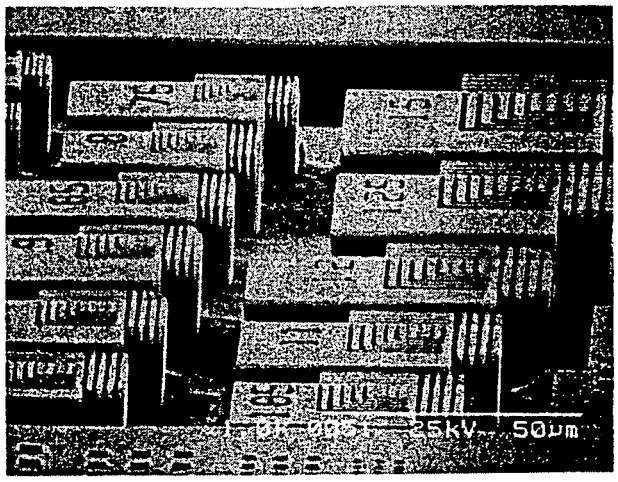
FIG. 15 illustrates the principles of the present invention by showing a scanning electron micrograph demonstrating the sub-micrometer minimum feature size capability of the present invention. Etched numerals indicate feature size in micrometers. The sample was etched for 7 minutes using an exemplary baseline TIDE process with parameters at 400 W ICP source power, 100 W sample RF power, 2 Pa pressure, 100 sccm $Cl_2$, and 5 sccm Ar.

However, it should be noted that aspect-ratio-dependent-etching (ARDE) phenomena not observed in the previous etching examples began to emerge. For example, as shown in FIG. 14, narrow cavities within the comb drive structure were etched more slowly than the surrounding open features. This can be attributed to RIE lag and is associated with local transport phenomena. Such effects were not observed in the earlier etching examples due to the short etch times used (2 min), which produced features with relatively low aspect ratios (maximum 3:1). FIG. 15 shows that the exemplary TIDE method is also capable of etching sub-micrometer features.

Variation of process conditions about the exemplary conditions discussed above resulted in the ability to produce a more optimized TIDE parameter set. These exemplary optimized parameters include an increased RF sample power and chamber pressure (400 W ICP source power, 150 W RF sample power, 2.5 Pa, 100 sccm $Cl_2$, and 5 sccm Ar). These method parameters of the present invention were used to etch a titanium substrate to produce the high aspect ratio features shown in FIG. 16. The etch rate and mask selectivity for these exemplary TIDE etch conditions were approximately 2.2 μm/min and 40:1 ($Ti:TiO_2$), respectively.

Figure 16:
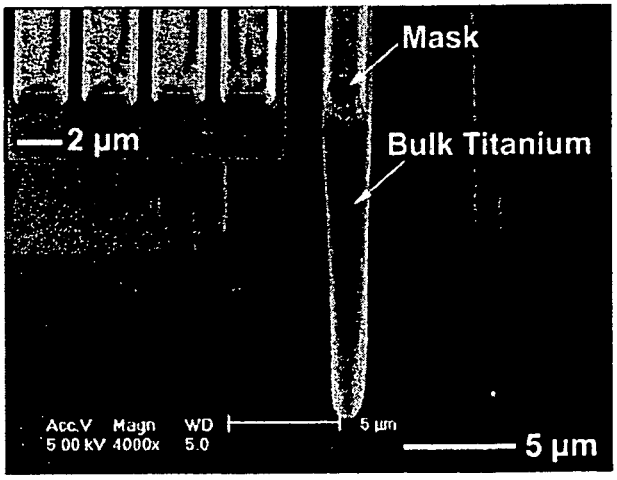
FIG. 16 illustrates the principles of the present invention by showing two scanning electron micrographs of a $TiO_2$ mask following the $CHF_3$ etch and solvent cleaning, prior to $O_2$ plasma to strip remaining fluorinated photoresist (inset) and a deep etched feature using a similarly defined mask and the present invention. The sidewalls and floor of the etched feature appear relatively smooth except at the top where the periphery of the mask was lost during the etch process because the $CHF_3$ etch currently being used to transfer patterns onto the $TiO_2$ masking layer resulted in slightly sloped sidewalls causing loss of mask which transferred into the deep etched titanium as the etch progressed. The sample was etched for 10 minutes using an exemplary baseline TIDE process with increased sample RF power of 150 W (vs. 100 W in FIG. 14) and pressure of 2.5 Pa (vs. 2 Pa in FIG. 14).

As shown in FIG. 16, these parameters resulted in deep etched features with good verticality (some tapering noticeable) and relatively smooth sidewalls. Slight micro-roughness did appear towards the base of the features. Roughness towards the top of the etched features is most likely due to loss of mask which was found to be dependent on the quality of the oxide etch. As further shown in FIG. 16, the $CHF_3$ etch used to define the mask pattern resulted in slightly sloped sidewalls, which eventually caused loss of mask around the periphery of the features as the etch progressed.

As those skilled in the art will appreciate, this mask loss may be addressed within the teachings of the present invention by either improving the directionality of the $CHF_3$ oxide etch or by using additional masking materials with even higher selectivity.

Figure 17:
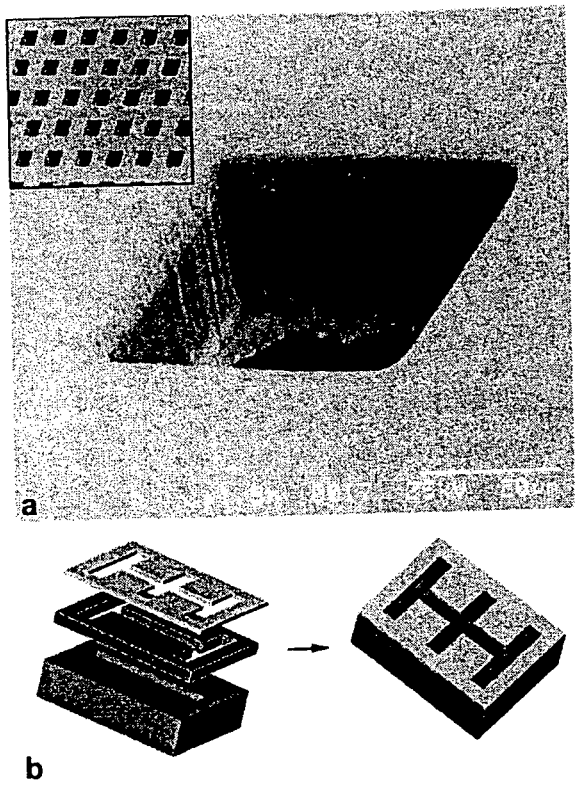
FIG. 17 illustrates the principles of the present invention by showing a scanning electron micrograph (a) of a through-etched titanium thin foil showing an array of 50×50 $\mu m^2$ square features and a closer look (inset) at a single square of the array. The titanium foil was 25 μm thick and required 12 minutes to through-etch using an exemplary TIDE process like that used in FIG. 14, and a schematic (b) depicting the concept of stacking and bonding through-etched thin titanium foils to create complex 3-dimensional structures of arbitrary, yet known cross-section utilizing the present invention.

The method of the present invention also can be used to etch titanium substrates having thinner cross sections such as thin titanium foils of varying thickness (10 μm to 100 μm). In accordance with the teachings of the present invention, this titanium foil etching can be used to etch completely through a foil, as shown in FIG. 17(*a*). Through etched titanium foils produced with the methods of the present invention provide new methods to design and manufacture microdevices with arbitrary, yet specific 3-D cross-sections through successive stacking and bonding of individual foils onto a substrate. Bonding methods for laminating such etched titanium substrates may include gold-gold thermal compression or anodic bonding. This concept is shown schematically in FIG. 17(*b*).

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the present invention is to be limited only by the scope of the appended claims immediately following the Bibliography.

BIBLIOGRAPHY

The following references are incorporated herein by reference:

1. S. M. Spearing, *Acta Mater.,* 48, 179 (2000).
2. M. F. Aimi, M. P. Rao, N. C. MacDonald, A. S. Zuruzi, and D. P. Bothman, *Nat. Mater.,* 3, 103 (2004).
3. D. M. Brunette, P. Tengvall, M. Textor, and P. Thomsen, *Titanium in Medicine: Material Science, Surface Science, Engineering, Biological Responses and Medical Applications*, p. 3-10, Springer, Berlin (2001).
4. K. Blumenstock and D. Stephani, *J. Vac. Sci. Technol. B,* 7, 627 (1989).
5. P. Unger, V. Bogli, and H. Beneking, *Microelectron. Eng.,* 5, 279 (1986).
6. R d'Agostino, F. Fracassi, and C. Pacifico, *J. Appl. Phys.,* 72, 4351 (1992).
7. N. M. Muthukrishnan, K. Amberiadis, and A. Elshabini-Riad, *J. Electrochem. Soc.,* 144, 1780 (1997).
8. Y. Kuo and A. G. Schrott, in *ULSI Science and Technology/* 1995. E. M. Middlesworth and H. Massoud, Editors, PV 95-5, p. 246, The Electrochemical Society Proceedings Series, Pennington, N.J. (1995).
9. R d'Agostino, F. Fracassi, C. Pacifico, and P. Capezzuto, *J. Appl. Phys.,* 71, 462 (1992).
10. R. R. Reeves, M. Rutten, S. Ramaswami, and P. Roessle, *J. Electrochem. Soc.,* 137, 3517 (1990).
11. C O'Mahoney, M. Hill, P. J. Hughes, and W. A. Lane, *J. Micromech. Microeng.,* 12, 438 (2002).
12. M. J. Madou, *Fundamentals of Microfabrication, p.* 78-79, 103, CRC Press LLC, Boca Raton, Fla. (2002).
13. S. A. Campbell, *The Science and Engineering of Microelectronic Fabrication*, p. 266-267, 514, Oxford University Press, New York (2001).
14. W. L. O'Brien, T. N. Rhodin, and L. C. Rathbun, *J. Chem. Phys.,* 89, 5264 (1988).
15. M. J. Donachie, *Titanium: A Technical Guide*, p. 13-14, ASM International, Materials Park, Ohio (2000).
16. S D. Senturia, *Microsystem Design*, p. 69, Kluwer Academic Publishers, Boston (2001).
17. D. A. Danner and D. W. Hess, *J. Appl. Phys.,* 59, 940 (1986).
18. A. M. Efremov, D. P. Kim, and C. I. Kim, *Thin Solid Films,* 435, 232 (2003).
19. A. M. Efremov, D. P. Kim, and C. I. Kim, *J. Vac. Sci. Technol. A,* 21, 1568, (2003).
20. I. W. Rangelow and H. Loschner, *J. Vac. Sci. Technol. B,* 13, 2394 (1995).
21. R. A. Gottscho and C. W. Jurgensen, *J. Vac. Sci. Technol. B,* 10, 2133 (1992).
22. E. R. Parker, B. J. Thibeault, M. F. Aimi, M. P. Rao, and N. C. MacDonald, *J. Electrochem. Soc.,* 152 (10) C675-C683 (2005).

What is claimed:

1. A monocyclic inductively coupled plasma titanium etch and rapid micromachining method, comprising:

providing a masked and patterned bulk titanium substrate; and inductively coupled plasma (ICP) etching said bulk titanium substrate with a gas composition comprising chlorine gas ($Cl_2$) and Argon (Ar), at an ICP source power ranging from about 100 W to 800 W, a Radio Frequency (RF) sample power ranging from about 50 W to 400 W, a pressure ranging from about 0.5 Pa to 4.0 Pa, a chlorine gas flow rate ranging from about 20 standard cubic centimeters per minute (sccm) to 120 sccm, an Ar flow rate up to 5 sccm, with the gas composition ranging from about 50% to 100% chlorine, and combing the ICP source power having an ICP frequency with the RF power having an RF frequency, wherein the titanium substrate is masked with a mask selectivity of no less than 40:1 (titanium:mask), a rate of the inductively coupled plasma etching is in excess of two microns per minute, and one or more structures with a height greater than their width and vertical or tapered sidewalls are created on the titanium substrate.

2. The monocyclic inductively coupled plasma titanium etch and rapid micromachining method of claim 1, wherein said source power ranges from about 200 W to about 800 W.

3. The monocyclic inductively coupled plasma titanium etch and rapid micromachining method of claim 1, wherein said source power ranges from about 400 W to about 800 W.

4. The monocyclic inductively coupled plasma titanium etch and rapid micromachining method of claim 1, wherein said RF sample power ranges from about 150 W to about 400 W.

5. The monocyclic inductively coupled plasma titanium etch and rapid micromachining method of claim 1, wherein said chlorine gas flow rate is at least 100 sccm.

6. The monocyclic inductively coupled plasma titanium etch and rapid micromachining method of claim 1, wherein said chlorine gas flow rate is 100 sccm and the Ar flow rate is 5 sccm.

7. The monocyclic inductively coupled plasma titanium etch and rapid micromachining method of claim 1, wherein said gas composition ranges from about 90% to 100% chlorine.

8. The method of claim 1, wherein a rate of the etching is in excess of two microns per minute and is faster than metal anisotropic reactive ion etching with oxidation.

9. The method of claim 1, wherein the Titanium substrate is masked with a titanium dioxide mask.

10. The method of claim 1, wherein the height is at least 20 micrometers.

11. The method of claim 10, wherein the width is one micrometer or less.

12. The method of claim 1, wherein a rate of the etching is faster, and a surface roughness of etched surfaces on vertical sidewalls of the structures is smoother, as compared to a rate of etching of and a surface roughness created by metal anisotropic reactive ion etching with oxidation and wherein the surface roughness is between 5 nanometers and 60 nanometers.

13. A method for etching titanium using a monocyclic inductively coupled plasma, comprising:

masking and patterning a bulk titanium substrate; and inductively coupled plasma etching said bulk titanium substrate with a vas composition comprising chlorine gas and selecting etching conditions and mask selectivity wherein one or more structures comprising a height greater than their width and vertical or tapered sidewalls are created on the titanium substrate and a rare of the inductively coupled plasma etching is at least one micron per minute.

14. The method of claim 13, further comprising selecting the etching conditions and a mask for the masking wherein the mask's selectivity to the etching is no less than 40:1 (Titanium:mask).

15. The method of claim 13, further comprising selecting the etching conditions and a Titanium Dioxide mask for the masking.

16. The method of claim 13, wherein the height is at least 20 micrometers.

17. The method of claim 13, wherein the width is one micrometer or less.

18. The method of claim 13, wherein a surface roughness of etched surfaces on the vertical sidewalls of the structures is smoother as compared to a surface roughness created by metal anisotropic reactive ion etching with oxidation and wherein the surface roughness is between 5 nanometers and 60 nanometers.

19. The method of claim 13, wherein a rate of the inductively coupled plasma etching is at least two microns per minute.

* * * * *